US011624213B2

(12) United States Patent
Guerin et al.

(10) Patent No.: US 11,624,213 B2
(45) Date of Patent: Apr. 11, 2023

(54) LOCKING SYSTEM FOR A DOOR LEAF OF A MOTOR VEHICLE COMPRISING A HANDLE OF THE FLUSH TYPE

(71) Applicant: U-Shin Italia S.p.A., Pianezza (IT)

(72) Inventors: Anthony Guerin, Pianezza (IT); Siavash Ostovari-Far, Pianezza (IT); Antonio Rocci, Pianezza (IT); Simone Ilardo, Pianezza (IT)

(73) Assignee: U-Shin Italia S.p.A., Pianezza (IT)

( * ) Notice: Subject to any disclaimer, the term of this patent is extended or adjusted under 35 U.S.C. 154(b) by 562 days.

(21) Appl. No.: 16/799,038

(22) Filed: Feb. 24, 2020

(65) Prior Publication Data

US 2020/0190866 A1 Jun. 18, 2020

Related U.S. Application Data

(63) Continuation of application No. PCT/EP2018/072411, filed on Aug. 20, 2018.

(30) Foreign Application Priority Data

Aug. 23, 2017 (EP) ..... 17187575

(51) Int. Cl.

| | |
|---|---|
| ***E05B 77/06*** | (2014.01) |
| ***E05B 85/10*** | (2014.01) |
| *E05B 85/16* | (2014.01) |

(52) U.S. Cl.

CPC ..... *E05B 77/06* (2013.01); *E05B 85/103* (2013.01); *E05B 85/16* (2013.01); *Y10S 292/22* (2013.01)

(58) Field of Classification Search

CPC ..... E05B 85/103; E05B 85/16; E05B 85/10; E05B 77/04; E05B 77/06; Y10S 292/22

See application file for complete search history.

(56) References Cited

U.S. PATENT DOCUMENTS

| | | | | |
|---|---|---|---|---|
| 2,317,699 A * | 4/1943 | Thompson | E05B 85/22 | 292/DIG. 31 |
| 2,317,700 A * | 4/1943 | Thompson | E05B 85/14 | 292/DIG. 31 |
| 6,218,933 B1 * | 4/2001 | Josserand | E05B 81/78 | 340/5.1 |
| 6,363,577 B1 * | 4/2002 | Spitzley | E05B 79/06 | 292/336.3 |
| 6,709,033 B2 * | 3/2004 | Jooss | E05B 85/16 | 292/336.3 |

(Continued)

FOREIGN PATENT DOCUMENTS

| | | |
|---|---|---|
| DE | 102008062213 | 6/2010 |
| EP | 2432954 | 5/2013 |

(Continued)

OTHER PUBLICATIONS

International Search Report for International Application PCT/EP2018/072411, dated Sep. 21, 2018.

*Primary Examiner* — Carlos Lugo
(74) *Attorney, Agent, or Firm* — Burris Law, PLLC

(57) ABSTRACT

A locking system for a motor vehicle door leaf includes a door leaf and a handle of the flush type that has at least one bracket, a gripping lever, a transmission lever, a first reversible inertial safety system, and a second irreversible inertial safety system.

15 Claims, 7 Drawing Sheets

(56) References Cited

U.S. PATENT DOCUMENTS

| | | | | |
|---|---|---|---|---|
| 7,036,855 | B2 * | 5/2006 | Lin | E05B 85/16 292/216 |
| 7,070,216 | B2 * | 7/2006 | von zur Muehlen | E05B 77/06 70/92 |
| 7,232,164 | B2 * | 6/2007 | Lee | E05B 77/06 292/336.3 |
| 7,635,151 | B2 * | 12/2009 | Rodawold, Jr. | E05B 85/16 292/336.3 |
| 8,857,866 | B2 * | 10/2014 | Savant | E05B 77/06 292/336.3 |
| 8,894,108 | B2 * | 11/2014 | Corwin | E05B 77/06 292/336.3 |
| 9,322,191 | B2 * | 4/2016 | Müller | E05B 85/107 |
| 9,567,777 | B1 * | 2/2017 | VandenBrink | E05B 77/02 |
| 10,280,658 | B2 * | 5/2019 | Halliwell | E05B 85/107 |
| 10,501,967 | B2 * | 12/2019 | Brown | E05B 85/107 |
| 10,975,598 | B2 * | 4/2021 | Guerin | E05B 85/103 |
| 2006/0038418 | A1 * | 2/2006 | Huizenga | E05B 79/20 292/336.3 |
| 2007/0069532 | A1 * | 3/2007 | Tenorio | E05B 77/06 292/336.3 |
| 2011/0163554 | A1 * | 7/2011 | Patel | E05B 77/06 292/216 |
| 2014/0145454 | A1 * | 5/2014 | Da Deppo | E05B 77/06 292/336.3 |
| 2015/0061305 | A1 * | 3/2015 | Inai | E05B 85/16 292/336.3 |
| 2016/0097222 | A1 * | 4/2016 | Niegeloh | E05B 77/06 292/336.3 |
| 2018/0002954 | A1 * | 1/2018 | Uemura | E05B 77/06 |
| 2020/0190866 | A1 * | 6/2020 | Guerin | E05B 85/103 |

FOREIGN PATENT DOCUMENTS

| | | |
|---|---|---|
| EP | 3106596 | 12/2016 |
| WO | 2010037622 | 4/2010 |
| WO | 2014203930 | 12/2014 |

* cited by examiner

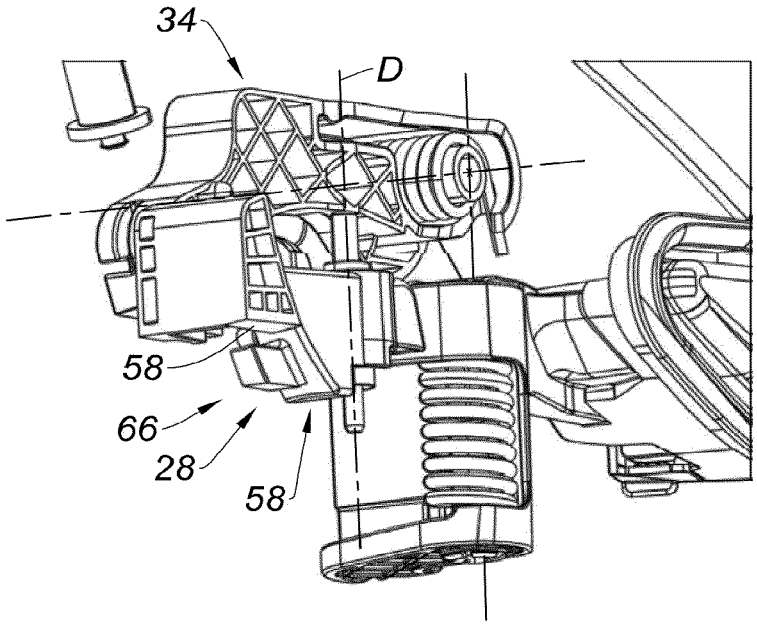
Fig. 8
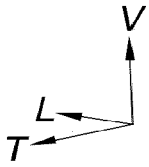
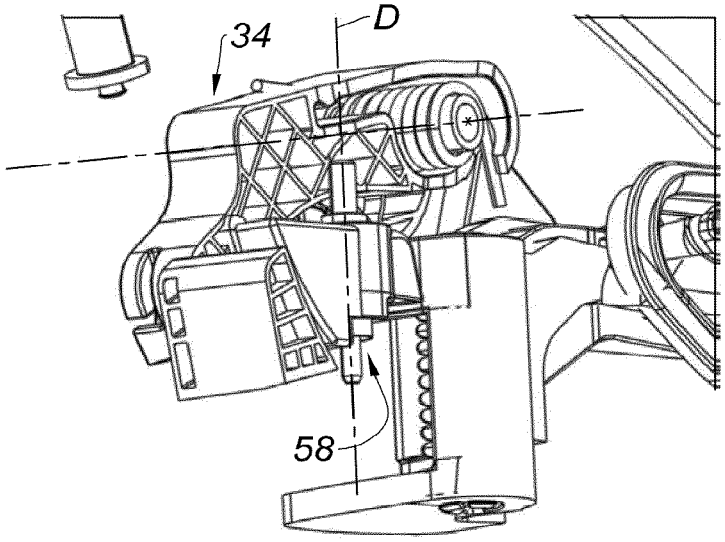
Fig. 9
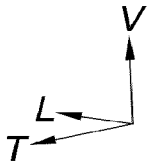
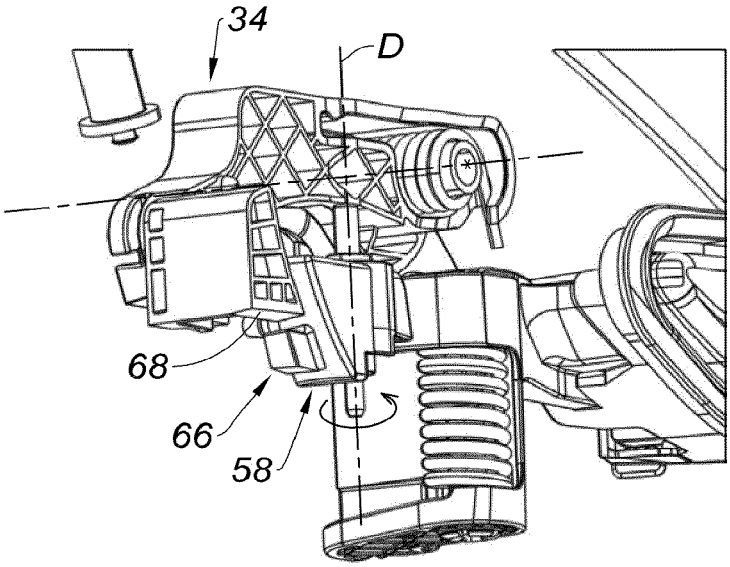
Fig. 10
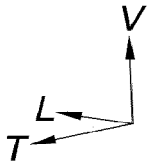

LOCKING SYSTEM FOR A DOOR LEAF OF A MOTOR VEHICLE COMPRISING A HANDLE OF THE FLUSH TYPE

CROSS-REFERENCE TO RELATED APPLICATIONS

This application is a continuation of International Application No. PCT/EP2018/072411, filed on Aug. 20, 2018, which claims priority to and the benefit of EP 17187575.0, filed on Aug. 23, 2017. The disclosures of the above applications are incorporated herein by reference.

FIELD

The present disclosure relates to a locking system for a door leaf of a motor vehicle which comprises a handle of the flush type, a door leaf and a dual inertial safety system.

BACKGROUND

The statements in this section merely provide background information related to the present disclosure and may not constitute prior art.

There is known a flush handle which is described and represented in the document EP-A1-3106596, and which is designed so as to visually merge with the associated door leaf.

The flush handle described in the document EP-A1-3106596 includes a bracket fastened on the door leaf, a gripping lever and a transmission lever.

The gripping lever comprises a gripping element, the gripping lever being movably mounted in rotation relative to a bracket about a first axis of rotation between at least one rest position in which the gripping element is flush with an outer face of the door leaf, an active position in which the gripping element protrudes with respect to the outer face of the door leaf and an opening position in which the gripping lever unlocks the door leaf.

The transmission lever is pivotally mounted relative to the bracket about a second axis of rotation, between a rest position and an actuation position in which the transmission lever actuates the opening of a lock of the door leaf, the transmission lever being driven in rotation by the gripping lever.

The gripping element of the gripping lever constitutes the visible portion which can be handled by the user to open the door leaf.

For safety reasons, it is known to associate an inertial safety system with the handle in order to avoid an inadvertent actuation of the handle in the event of an impact of the vehicle.

In particular, a handle is known which includes a dual inertial safety system which is described in the document EP-B1-2432954.

The EP-B1-2432954 dual inertial safety system includes a first reversible inertial system, which includes a first inertial mass which temporarily blocks the transmission lever, and a second irreversible safety system which includes a second inertial mass which blocks the transmission lever irreversibly, thus avoiding a possible bouncing of the inertial mass.

Although the dual safety system described in the document EP-B1-2432954 seems effective, its bulk makes it hardly compatible with a handle of the flush type.

Indeed, the kinematics of a handle of the flush type has a considerable bulk and requires a reduced bulk of the inertial safety system.

SUMMARY

This section provides a general summary of the disclosure and is not a comprehensive disclosure of its full scope or all of its features.

The present disclosure provides a locking system for a door leaf of a motor vehicle, the system comprising a door leaf which extends longitudinally, in a vertical plane, from a front edge up to a rear edge, and a handle of the flush type comprising at least a bracket which is adapted to be fastened on the door leaf, a gripping lever which comprises a gripping element, the gripping lever being movably mounted in rotation relative to the bracket about a first axis of rotation, between at least one rest position in which the gripping element is flush with an outer face of the door leaf, an active position in which the gripping element protrudes with respect to the outer face of the door leaf and an opening position in which the gripping lever unlocks the door leaf, and a transmission lever which delimits a first blocking face and a second blocking face, and which is pivotally mounted relative to the bracket about a second axis of rotation perpendicular to the first axis of rotation of the gripping lever, between a rest position and an actuation position in which the transmission lever actuates the opening of a lock of the door leaf, the transmission lever being driven in rotation by the gripping lever.

The locking system further includes a first reversible inertial safety system which is mounted on the bracket and which includes a first rocker bearing a first inertial mass, a first rocker which includes a first blocking finger and which is pivotally mounted about a third pivot axis substantially perpendicular to the second axis of rotation of the transmission lever, between a rest position and a blocking position in which the first blocking finger inhibits the rotation of the transmission lever in the event of an impact, and a second irreversible inertial safety system which is mounted on the bracket and which includes a second rocker bearing a second inertial mass, which second rocker includes a second blocking finger and which is pivotally mounted about a fourth pivot axis substantially parallel to the third pivot axis of the first rocker, between a rest position and a blocking position in which the second blocking finger prevents the rotation of the transmission lever in the event of an impact.

Advantageously, the system according to the present disclosure comprises a first reversible safety system and a second irreversible safety system, each of which independently act on an element of the kinematic chain of the opening of the door leaf, more particularly on the transmission lever.

In addition, the orientation of the pivot axes of the rockers of each safety system and the orientation of the axis of rotation of the transmission lever allow for a compact arrangement of the system according to the present disclosure, which is adapted to a handle of the flush type.

Indeed, a handle of the flush type includes an actuator for driving the gripping lever, which limits the space available for the safety systems.

According to another feature, the third pivot axis of the first rocker and the fourth pivot axis of the second rocker are substantially parallel along a vertical direction.

According to another feature, the axis of rotation of the transmission lever extends transversely, perpendicularly to the vertical axis of rotation of the gripping lever.

According to another feature, the first rocker is driven from its rest position up to its blocking position when the acceleration of the first inertial mass is within a first range of values in the event of an impact and the second rocker is driven from its rest position up to its blocking position when the acceleration of the second inertial mass is within a second range of values in the event of an impact.

This feature enables the safety systems to respond to a wide range of acceleration values independently of each other.

According to another feature, the gripping element is delimited longitudinally by a front end which is arranged opposite a central area of the door leaf, and a rear end, the first inertial mass and the second inertial mass each being arranged longitudinally at the front of the front end of the gripping element.

This feature makes it possible to limit the bulk of the system according to the present disclosure.

In addition, the position of the inertial masses at the front of the gripping element allows approaching each safety system towards the center of the door leaf so as to make each safety system more reactive.

More particularly, the axis of rotation of the gripping lever generally extends vertically at the front of the front end of the gripping element, the inertial masses, being arranged longitudinally at the front of the axis of rotation of the gripping lever.

According to another feature, each inertial mass, is arranged longitudinally between a central area of the door leaf and the axis of rotation of the gripping lever.

The present disclosure also concerns a door handle adapted to equip a locking system according to any one of the features herein.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 8 is a detail perspective view which illustrates the rocker of the first safety system in its rest position and the transmission lever in its rest position;

FIG. 9 is a detail perspective view which illustrates the rocker of the first safety system in its rest position and the transmission lever in its actuation position;

FIG. 10 is a detail perspective view which illustrates the rocker of the first safety system in its blocking position and the transmission lever in its rest position;

Figure 1:
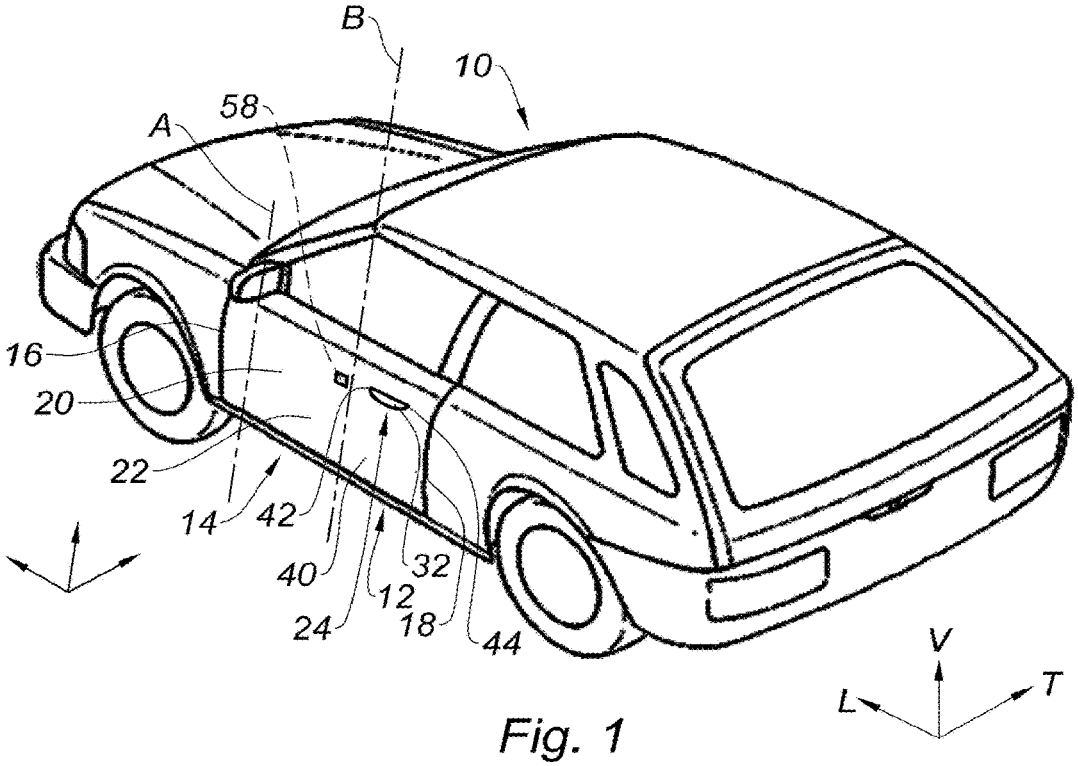
FIG. 1 is a schematic perspective view illustrating a handle and a door leaf of a motor vehicle belonging to the locking system, according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the present application, the terms "top", "bottom", "upper", "lower", "horizontal", "vertical" and their derivatives refer to the position or the orientation of an element or a component, the position or orientation being considered when the vehicle is in a service configuration on a horizontal ground.

In addition, to clarify the description and the claims, the terminology longitudinal, vertical and transverse will be adopted in a non-restrictive manner, with reference to the trihedron L, V, T indicated in the Figures.

In all of these Figures, identical or similar reference numerals represent identical or similar members or sets of members.

It should be noted that in the present patent application, the terms "front" and "rear" should be understood with respect to the longitudinal general direction of the vehicle, that is to say from left to right in FIG. 1.

FIG. 1 shows a motor vehicle 10 which is equipped with a locking system 12 for a door leaf according to the present disclosure.

The locking system 12 comprises a door leaf 14 which extends longitudinally, in a vertical plane, from a front edge 16 up to a rear edge 18, the door leaf 14 comprising a central area 20 which is interposed longitudinally between the front edge 16 and the rear edge 18.

The door leaf 14 is delimited by a trimming outer face 22 which is arranged outside of the vehicle.

Also, the door leaf 14 is pivotally mounted between a closed position, illustrated in FIG. 1, and an opening position, about an opening axis A which extends vertically, in the vicinity of the front edge 16 of the door leaf 14.

Figure 2:
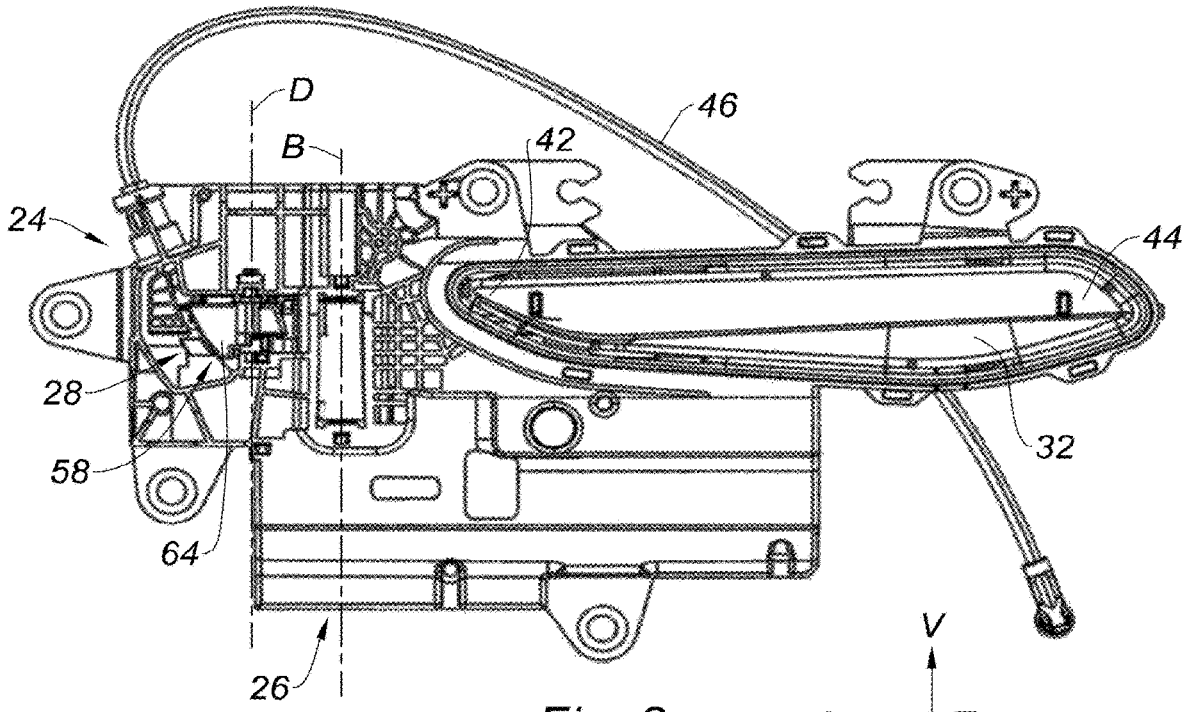
FIG. 2 is a front view which illustrates the gripping lever of the handle of FIG. 1 in its rest position and a first inertial safety system, with the bracket of the handle.
Figure 3:
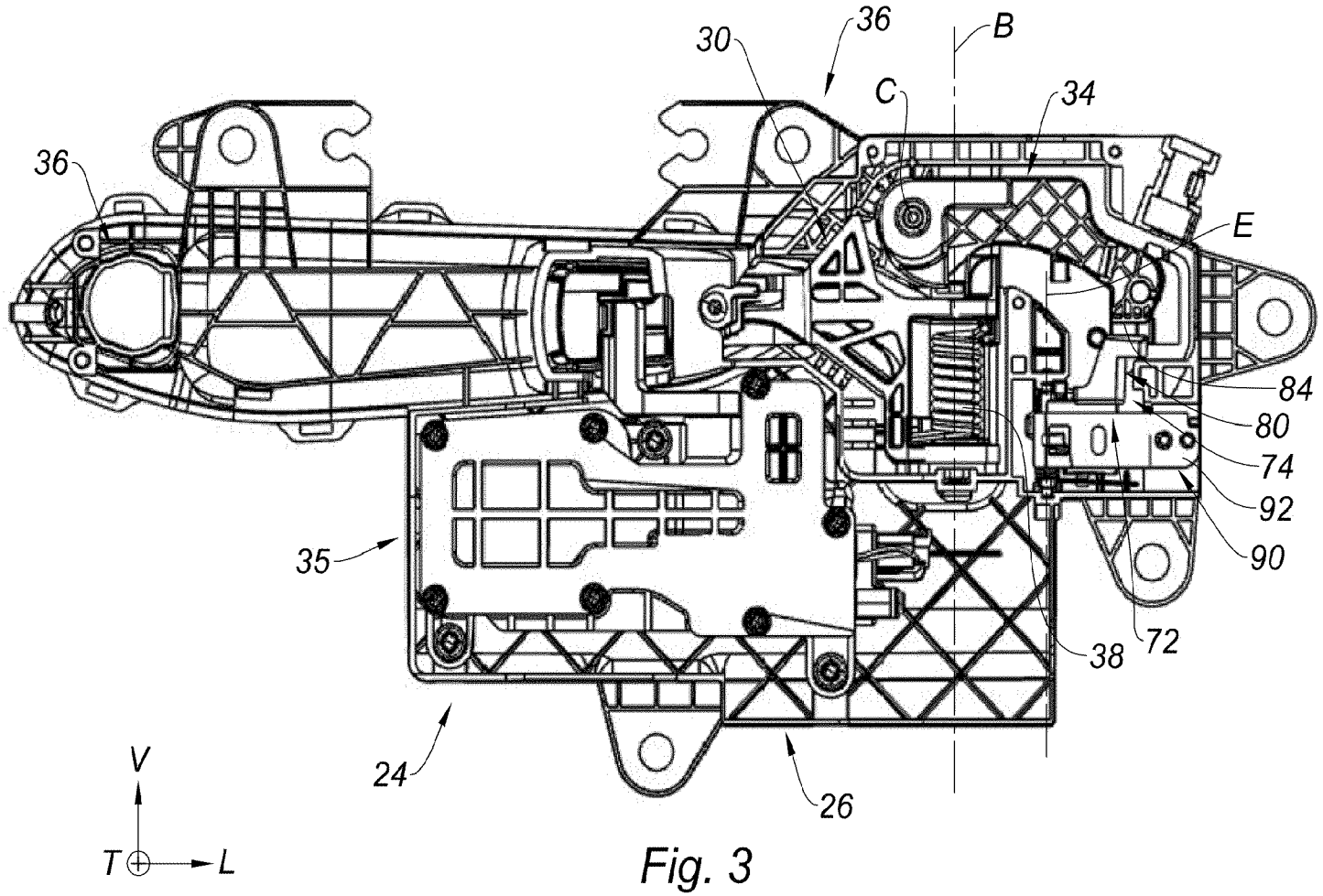
FIG. 3 is a rear view which illustrates the transmission lever in its rest position, with the bracket.

Referring to FIGS. 2 and 3, the locking system 12 includes a handle 24 which comprises a bracket 26, a mechanism for opening a lock 36 of the door leaf 14, a first reversible inertial safety system 28 and a second irreversible inertial safety system 72, each of which aims at inhibiting the inadvertent opening of the door leaf 14 in the event of an impact of motor vehicle 10 against an obstacle.

The bracket 26 generally has the shape of a plate which extends in the plane of the door leaf 14 and which is fastened to a structure (not represented) of the door leaf by screws (not represented) for example.

The opening mechanism of the lock 36 includes a gripping lever 30, a gripping element 32 and a transmission lever 34.

Figure 4:
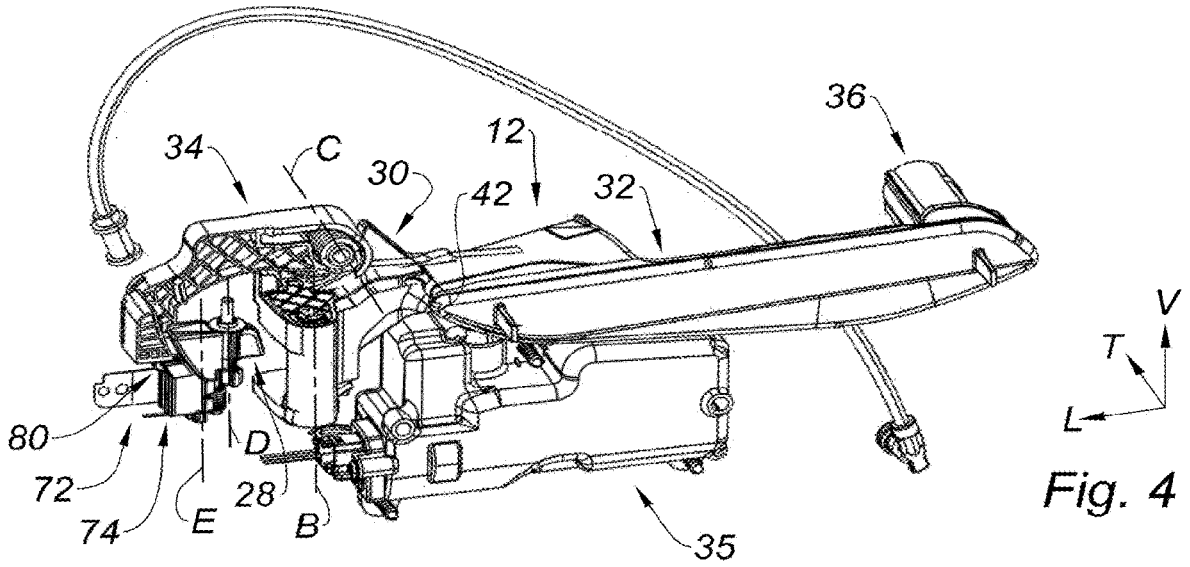
FIG. 4 is a perspective view which illustrates the gripping element in its rest position in which the gripping element is flush with an outer face of the door leaf.
Figure 5:
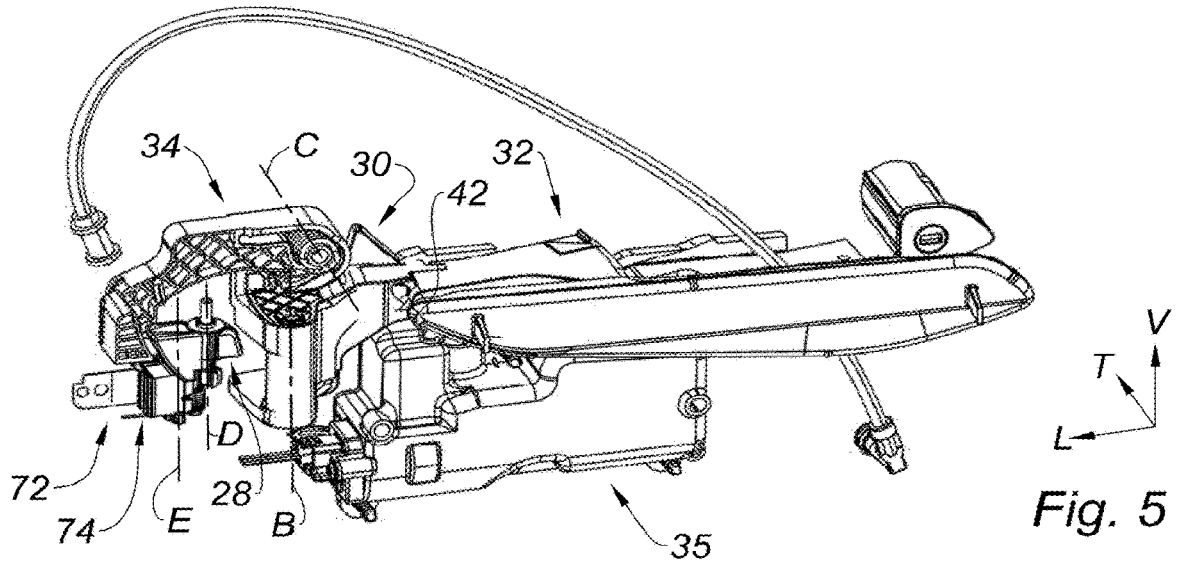
FIG. 5 is a perspective view which illustrates the gripping element in its active position in which the gripping element protrudes with respect to the outer face of the door leaf.
Figure 6:
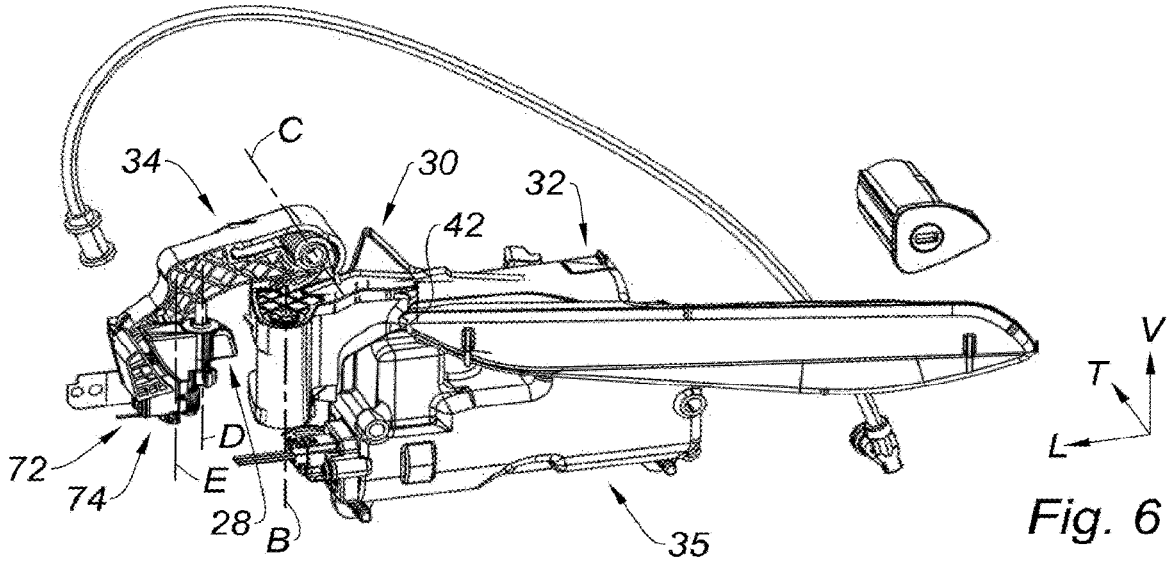
FIG. 6 is a perspective view which illustrates the gripping element in an opening position in which the gripping lever unlocks the door leaf.

The gripping lever 30 is movably mounted in rotation relative to the bracket 26 about a first vertical axis B of rotation, between a rest position illustrated in FIGS. 2 to 4, in which the gripping element 32 is flush with the outer face 22 of the door leaf 14, an active position illustrated in FIG. 5, in which the gripping element 32 protrudes with respect to the outer face 22 of the door leaf 14 in order to be pivoted by a user, and an opening position illustrated in FIG. 6, in which the gripping lever 30 actuates the lock in order to unlock the door leaf 14.

Complementarily, the opening mechanism includes an actuator 35, shown in FIG. 4, which is designed so as to pivotally drive the gripping lever 30 between its rest position and its active position.

The gripping lever 30 is elastically biased towards its rest position by a helical spring 38 which extends vertically around the axis B of rotation of the gripping lever 30 and which is linked to the bracket 26.

The gripping element 32 is designed so as to enable a user to actuate the gripping lever 30.

As shown in FIG. 1, the gripping element 32 is arranged on an outer side of the door leaf 14, in a housing 40 formed by the outer face 22 of the door leaf 14, the gripping element 32 being secured to the gripping lever 30 in order to drive the gripping lever 30 in rotation when the user actuates the gripping element 32.

The gripping element 32 is in the form of an elongated handle which extends longitudinally from a front end 42 up to its rear end 44.

It should be noted that the gripping element 32 is represented without its trimming cap in FIGS. 2, and 4 to 6, where the trimming cap is flush with the outer face 22 of the door leaf when the gripping lever 30 occupies its rest position.

Also, the gripping lever 30 is arranged so as to drive the transmission lever 34 in movement, in order to actuate the opening of the lock of the door leaf 14.

The transmission lever 34 is pivotally mounted relative to the bracket 26 about a second transverse axis C of rotation, between a rest position illustrated in FIGS. 2 to 4, and an actuation position illustrated in FIG. 6, in which the transmission lever 34 actuates the opening of the lock of the door leaf 14.

Figure 7:
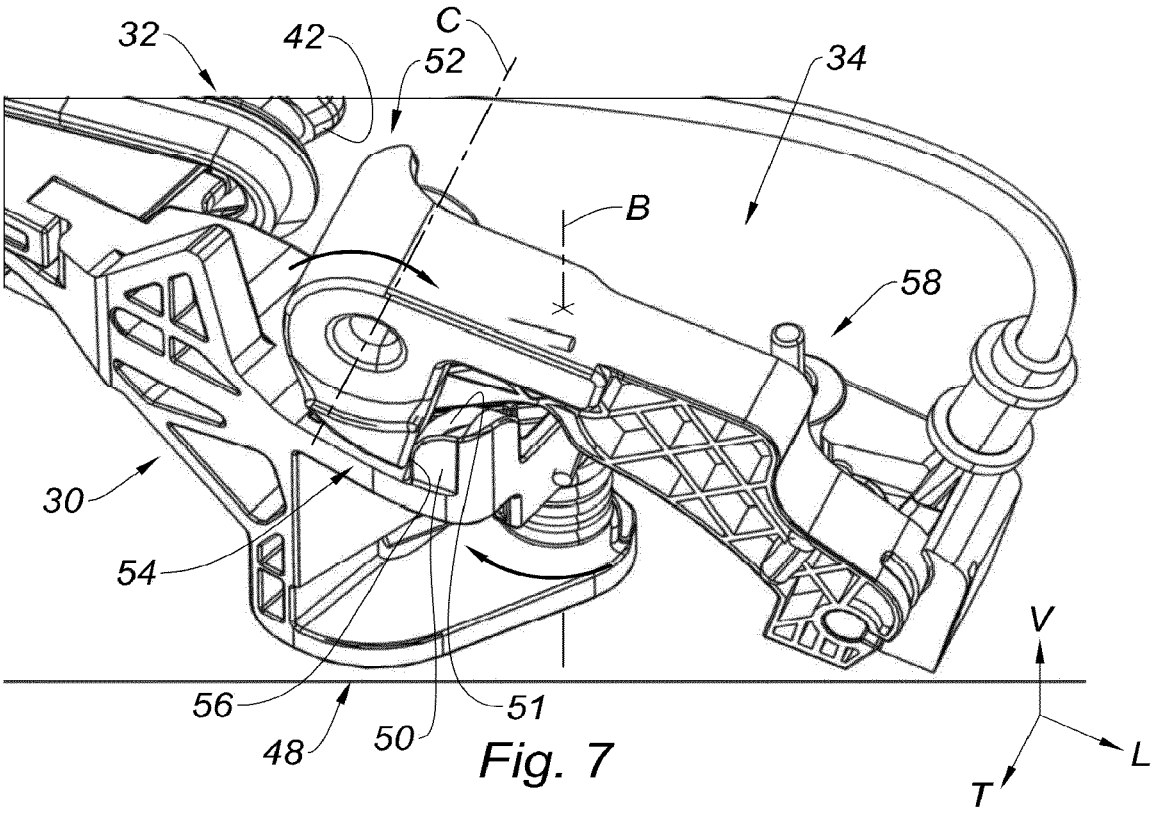
FIG. 7 is a detail perspective view which illustrates the transmission lever during the pivoting.

In addition, with reference to FIG. 7, the front end 48 of the gripping lever 30 delimits a cam 50 which has a profile 51 generally shaped as a spherical portion.

Complementarily, the rear end 52 of the transmission lever 34 includes a follower 54 delimiting a bearing face 56 which extends transversely, opposite the cam 50.

The cam 50 and the follower 54 are arranged so as to transform the rotational movement of the gripping lever 30 about its vertical axis B into a rotational movement of the actuating lever 34 about its transverse axis C.

The handle 24 is a handle of the flush type, also called a "flush" handle, that is to say that the gripping element 32 is flush with the outer face 22 of the door leaf 14 and visually merges with the outer face 22 of the door leaf 14 when the gripping lever 30 occupies its rest position.

The handle 24 is described in the document EP-A1-3106596 to which reference should be made for further details, and the contents of which are incorporated herein by reference in their entirety.

Figure 12:
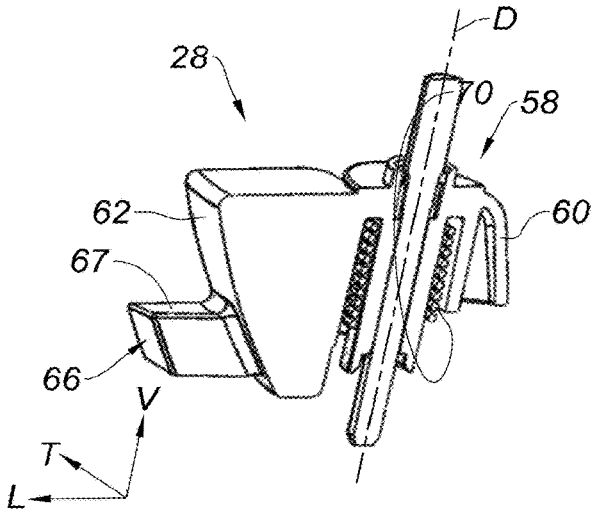
FIG. 12 is a detail perspective cross-sectional view, in longitudinal section, which illustrates the rocker of the first safety system.
Figure 13:
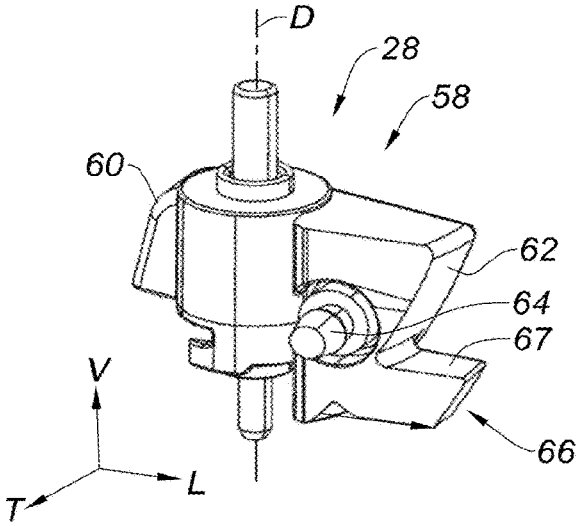
FIG. 13 is a detail perspective view which illustrates the rocker of the first safety system.

According to another aspect, the first reversible inertial safety system 28 includes a first rocker 58 represented in detail in FIGS. 12 and 13, which extends longitudinally from a rear end 60, up to a front end 62 which bears a first inertial mass 64.

The front end 62 of the first rocker 58 comprises a first blocking finger 66 which protrudes longitudinally forwards and which delimits a first blocking face 67 extending radially and perpendicularly to the axis D of rotation of the first rocker 58.

Figure 11:
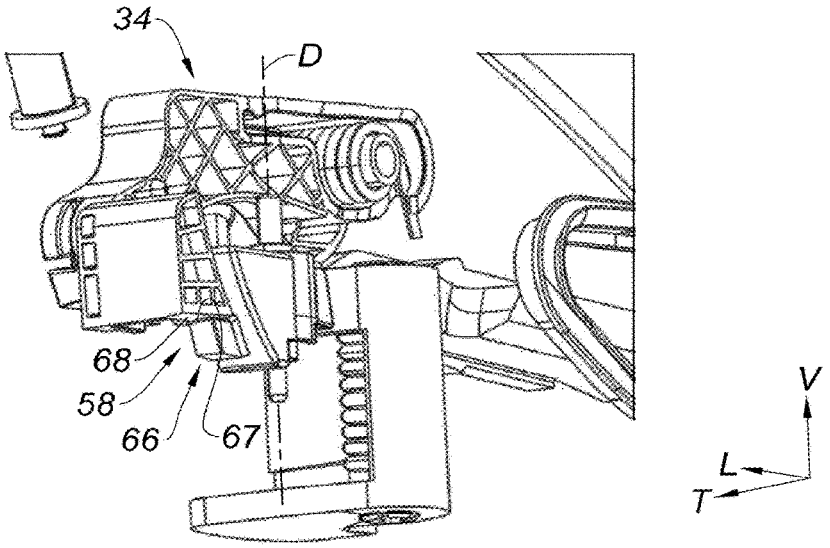
FIG. 11 is a detail perspective view which illustrates the rocker of the first safety system in its blocking position and the transmission lever in a blocked position.

The first blocking face 67 of the first rocker 58 is designed so as to cooperate with a first blocking face 68 delimited by the transmission lever 34, which generally extends parallel to the first blocking face 67 of the first rocker 58, in order to oppose the rotation of the transmission lever 34 from its rest position towards its actuation position in the event of an impact of the vehicle, as shown in FIG. 11.

The first rocker 58 is pivotally mounted about the third vertical axis D of rotation, between a rest position illustrated in FIGS. 8 and 9, and a blocking position illustrated in FIGS. 10 and 11, in which the first blocking finger 66 of the first rocker 58 is positioned on the path of the transmission lever 34 so that the first blocking face 68 of the transmission lever 34 strikes the first blocking finger 66 of the first rocker 58 to prevent the rotation of the transmission lever 34, so as to block the opening of the door leaf 14.

The axis D of rotation of the first rocker 58 is interposed between the rear end 60 and the front end 62 of the first rocker 58.

The first reversible inertial safety system 28 is a reversible system, that is to say that the first rocker 58 temporarily occupies its blocking position, in order to enable the opening of the door leaf 14 within a short period of time, following the actuation of the first reversible inertial safety system 28.

Referring to FIG. 12, the first rocker 58 is equipped with a helical spring 70 which extends around the axis D of rotation of the first rocker 58 and which cooperates with the bracket to elastically bias the first rocker 58 from its blocking position towards its rest position.

Thus, the first rocker 58 is elastically biased into its initial rest position when the acceleration applied on the first rocker 58 becomes zero again.

The first rocker 58 is designed so as to be driven from its rest position up to its blocking position when the acceleration of the first inertial mass 64 is within a first range of values comprised between 5G and 15G for example, the acceleration unit G amounting to 9.80665 $m \cdot s^{-2}$.

The first reversible inertial safety system 28 is therefore very reactive and quick to switch into a blocking position.

According to another aspect of the present disclosure, the first inertial mass 64 of the first rocker 58 is arranged longitudinally, at the front of the front end 42 of the gripping element 32, as shown in FIG. 2.

More particularly, the first inertial mass 64 of the first rocker 58 is arranged longitudinally, at the front of the axis B of rotation of the gripping lever 30, the axis B of rotation of the gripping lever 30 being arranged at the front of the front end 42 of the gripping element 32.

In general, with reference to FIG. 1, the first inertial mass 64 is arranged longitudinally between the central area 20 of the door leaf 14 and the axis B of rotation of the gripping lever 30.

Indeed, after an impact of the vehicle against an obstacle, the central area 20 of the door leaf 14 is deformed at a higher velocity than the periphery of the door leaf 14 due to the greater flexibility of the central area 20 of the door leaf 14 with respect to the periphery of the door leaf 14.

Thus, the closer the first inertial mass 64 of the first reversible inertial safety system 28 is arranged to the central area 20 of the door leaf 14, the more the first reversible inertial safety system 28 is reactive to block the opening mechanism of the door leaf 14.

Referring to FIGS. 3, 14, 15, and 16, the second irreversible inertial safety system 72 includes a second rocker 74 which extends longitudinally from a rear end 76 up to a front end 78 which bears a second inertial mass 80.

The front end 78 of the second rocker 74 comprises a second blocking finger 82 which protrudes longitudinally forwards and which delimits a second blocking face 84 extending radially and perpendicularly to the axis E of rotation of the second rocker 74.

Figure 16:
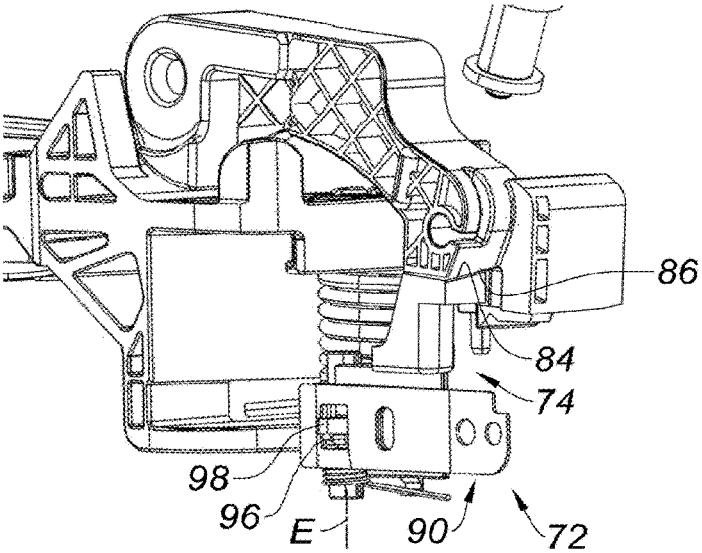
FIG. 16 is a detail perspective view which illustrates the rocker of the second safety system in its blocking position and the transmission lever in a blocked position.
Figure 16:
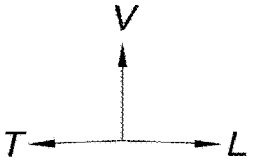

The second blocking face 84 of the second rocker 74 is designed so as to cooperate with a second blocking face 86 delimited by the transmission lever 34, which generally extends parallel to the second blocking face 84 of the second rocker 74, to oppose the rotation of the transmission lever 34 from its rest position towards its actuation position, in the event of an impact of the vehicle, as shown in FIG. 16.

Figure 14:
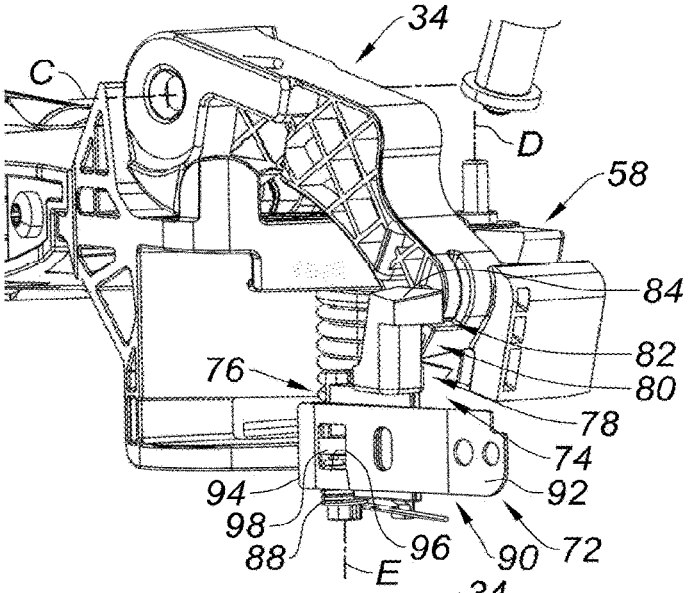
FIG. 14 is a detail perspective view which illustrates the second rocker of the second safety system in its rest position and the transmission lever in its actuation position.
Figure 14:
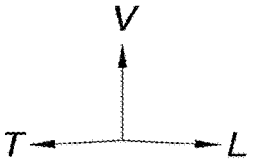
Figure 15:
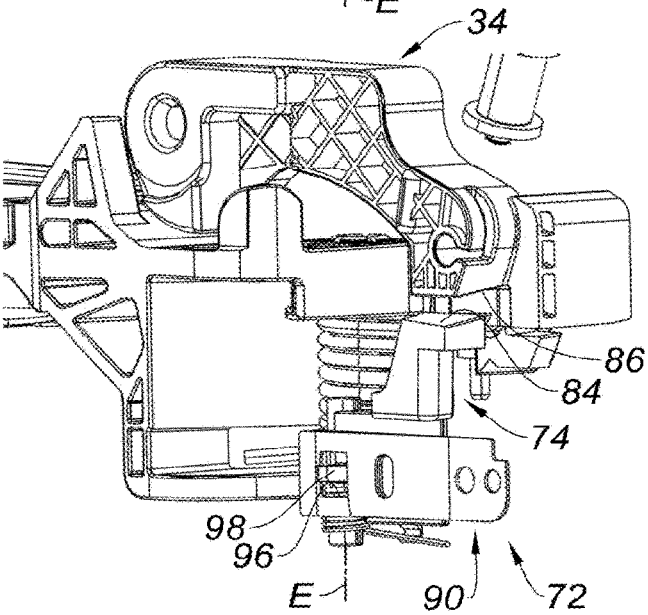
FIG. 15 is a detail perspective view which illustrates the rocker of the second safety system in its blocking position and the transmission lever in its rest position.
Figure 15:
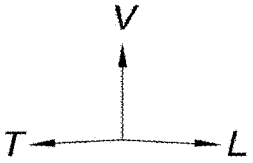

The second rocker 74 is pivotally mounted about the fourth pivot axis E which is substantially parallel to the third pivot axis D of the first rocker 58, between a rest position illustrated in FIG. 14, in which the second blocking finger 82 is spaced apart from the path of the transmission lever 34, and a blocking position illustrated in FIGS. 15 and 16, in which the second blocking finger 82 is positioned on the path of the transmission lever 34, so that the second blocking face 86 of the transmission lever 34 strikes the second blocking finger 82 to prevent the rotation of the transmission lever 34, so as to block the opening of the door leaf 14.

The second irreversible inertial safety system 72 is equipped with a helical spring 88 which extends about the fourth axis E and which elastically links the bracket 26 to the second rocker 74 to elastically urge the second rocker 74 into its rest position.

The helical spring 88 is calibrated so as to enable the pivoting of the second rocker 74 from an acceleration threshold value applied on the second rocker 74 during an impact.

More particularly, the second rocker 74 is designed so as to be driven from its rest position up to its blocking position when the acceleration of the second inertial mass 80 is within a second range of values starting from 30G, for example.

Also, the axis E of rotation of the second rocker 74 is arranged in the vicinity of the rear end 76 of the second rocker 74.

The second irreversible inertial safety system 72 is an irreversible system, that is to say that the second rocker 74 occupies its blocking position definitively, in order to prevent any possible bouncing of the second rocker 74 from its blocking position towards its rest position.

Now referring to FIG. 14, the second irreversible inertial system 72 includes a locking blade 90 which extends longitudinally from a front end 92 which is linked to the bracket 26 (shown in FIG. 3), up to a rear free end 94.

The rear free end 94 of the locking blade 90 delimits an aperture 96.

Complementarily, the second rocker 74 includes a lug 98 which protrudes perpendicularly to the pivot axis E of the second rocker 74.

The lug 98 is designed so as to push, during the pivoting of the second rocker 74, the locking blade 90 until penetrating through the aperture 96 into a locking position in which the lug 98 cooperates with an edge of the aperture 96 to retain the second rocker 74 in its blocking position, as shown in FIGS. 15 and 16.

According to another aspect of the present disclosure, the second inertial mass 80 of the second rocker 74 is arranged longitudinally at the front of the front end 42 of the gripping element 32, as shown in FIG. 4.

More particularly, the second inertial mass 80 of the second rocker 74 is arranged longitudinally at the front of the axis B of rotation of the gripping lever 30, the axis B of rotation of the gripping lever 30 being arranged at the front of the front end 42 of the gripping element 32.

In general, with reference to FIG. 1, the second inertial mass 80 is arranged longitudinally between the central area 20 of the door leaf 14 and the axis B of rotation of the gripping lever 30, for the same reasons as those previously mentioned concerning the first inertial mass 64.

The following example of the present disclosure is provided as a non-limiting example.

It should be understood that simple mechanical reversals are covered by the present disclosure.

For example, the first rocker 58 and/or the second rocker 74 may indifferently block the rotation of the gripping lever 30, or the rotation of the transmission lever 34, or any other element of the kinematic chain of the opening of the door leaf 14.

It should be noted that the axis D of rotation of the first rocker 58, the axis B of rotation of the gripping lever 30 and the axis E of rotation of the second rocker 74 are all parallel and perpendicular to the axis C of rotation of the transmission lever 34. Advantageously, the locking system 12 according to the present disclosure proposes a compact arrangement which enables a handle of the flush type equipped with an actuator 35 as well as a first inertial safety system and a second inertial safety system.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A locking system for a door leaf of a motor vehicle, the locking system comprising:

a bracket adapted to be fastened on the door leaf;

a gripping lever comprising a gripping element, the gripping lever being movably mounted in rotation relative to the bracket about a first axis of rotation between at least one rest position in which the gripping element is flush with an outer face of the door leaf, an active position in which the gripping element protrudes with respect to the outer face of the door leaf, and an opening position in which the gripping lever unlocks the door leaf;

a transmission lever having a first blocking face and a second blocking face, the transmission lever being pivotally mounted relative to the bracket about a second axis of rotation perpendicular to the first axis of rotation of the gripping lever, between a rest position and an actuation position in which the transmission lever actuates opening of a lock of the door leaf, the transmission lever being driven in rotation by the gripping lever;

a first reversible inertial safety system mounted on the bracket and including a first rocker having a first inertial mass and a first biasing member, the first rocker including a first blocking finger pivotally mounted about a third pivot axis perpendicular to the second axis of rotation of the transmission lever, between a rest position and a temporary blocking position in which the first blocking finger inhibits rotation of the transmission lever in an impact event, and is configured to be reversed from the temporary blocking position back toward the rest position by the first biasing member; and a second irreversible inertial safety system mounted on the bracket and including a second rocker having a second inertial mass, the second rocker including a second blocking finger pivotally mounted about a fourth pivot axis parallel to the third pivot axis of the first rocker, between a rest position and a blocking position in which the second blocking finger is definitively positioned to inhibit rotation of the transmission lever in the impact event.

2. The locking system according to claim 1, wherein the third pivot axis of the first rocker and the fourth pivot axis of the second rocker are parallel along a vertical direction.

3. The locking system according to claim 1, wherein the second axis of rotation of the transmission lever extends in a transverse direction of the vehicle.

4. The locking system according to claim 1, wherein the first rocker is driven from its rest position to its temporary blocking position when acceleration of the first inertial mass is within a first range of values in the impact event, and the second rocker is driven from its rest position to its blocking position when acceleration of the second inertial mass is within a second range of values in the impact event.

5. The locking system according to claim 4, wherein a minimum value of the second range of values is greater than a maximum value of the first range of values.

6. The locking system according to claim 5, wherein the first range of values is comprised between 5G and 15G, wherein G is gravitational acceleration.

7. The locking system according to claim 5, wherein the minimum value of the second range is 30G, wherein G is gravitational acceleration.

8. The locking system according to claim 4, wherein the first range of values is comprised between 5G and 15G, and a minimum value of the second range is 30G, wherein G is gravitational acceleration.

9. The locking system according to claim 1, wherein the gripping element is delimited longitudinally by a front end arranged opposite a central area of the door leaf and a rear end of the door leaf, each of the first inertial mass and the second inertial mass being arranged longitudinally at a front of the front end of the gripping element.

10. The locking system according to claim 9, wherein the first axis of rotation of the gripping lever extends vertically at the front of the front end of the gripping element, the first inertial mass and the second inertial mass being arranged longitudinally at the front of the first axis of rotation of the gripping lever.

11. The locking system according to claim 1, wherein the first inertial mass and the second inertial mass are arranged longitudinally between a central area of the door leaf and the first axis of rotation of the gripping lever.

12. A door handle adapted to equip the locking system according to claim 1.

13. The locking system according to claim 1, wherein the first rocker is driven from its rest position to its temporary blocking position in response to acceleration of the first inertial mass exceeding a first predetermined threshold value in the impact event, and the second rocker is driven from its rest position to its blocking position in response to acceleration of the second inertial mass exceeding a second predetermined threshold value in the impact event, the second predetermined threshold value being greater than the first predetermined threshold value.

14. The locking system according to claim 13, wherein the second irreversible inertial safety system includes a second biasing member that biases the second blocking finger toward its rest position.

15. The locking system according to claim 13, wherein the second irreversible inertial system includes a locking blade configured to retain the second rocker in its blocking position upon the second rocker reaching to its blocking position.

* * * * *